United States Patent [19]

Butterworth et al.

[11] Patent Number: 4,627,925

[45] Date of Patent: Dec. 9, 1986

[54] AQUEOUS CONCENTRATED FABRIC SOFTENING COMPOSITION

[75] Inventors: Robert M. Butterworth; John R. Martin; Edwin Willis, all of Merseyside, England

[73] Assignee: Lever Brothers Company, New York, N.Y.

[21] Appl. No.: 719,676

[22] Filed: Apr. 4, 1985

[30] Foreign Application Priority Data

Apr. 19, 1984 [GB] United Kingdom ..... 8410321

[51] Int. Cl.[4] ..... D06M 11/00

[52] U.S. Cl. ..... 252/8.8; 252/8.6

[58] Field of Search ..... 252/8.6, 8.8

[56] References Cited

U.S. PATENT DOCUMENTS

| | | | |
|---|---|---|---|
| 3,451,927 | 6/1969 | Tune | 252/8.75 |
| 3,974,076 | 8/1976 | Wiersema | 252/8.8 |
| 4,076,632 | 2/1978 | Davis | 252/8.8 |
| 4,157,307 | 6/1979 | Jaeger et al. | 252/8.75 |
| 4,351,737 | 9/1982 | Billenstein et al. | 252/8.8 |
| 4,464,273 | 8/1984 | Parslow et al. | 252/8.8 |
| 4,497,716 | 2/1985 | Tai | 252/8.8 |

FOREIGN PATENT DOCUMENTS

| | | |
|---|---|---|
| 4121 | 9/1979 | European Pat. Off. . |
| 22555 | 1/1981 | European Pat. Off. . |
| 23334 | 2/1981 | European Pat. Off. . |
| 56695 | 7/1982 | European Pat. Off. . |
| 59502 | 9/1982 | European Pat. Off. . |
| 60003 | 9/1982 | European Pat. Off. . |
| 74056 | 3/1983 | European Pat. Off. . |
| 82456 | 7/1983 | European Pat. Off. . |
| 94118 | 11/1983 | European Pat. Off. . |
| 107479 | 5/1984 | European Pat. Off. . |
| 2905881 | 8/1980 | Fed. Rep. of Germany . |
| 947714 | 1/1964 | United Kingdom . |
| 1084232 | 9/1967 | United Kingdom . |
| 1459935 | 12/1976 | United Kingdom . |
| 1538866 | 1/1979 | United Kingdom . |
| 2115847 | 9/1983 | United Kingdom . |

*Primary Examiner*—Paul Lieberman
*Assistant Examiner*—Willie J. Thompson
*Attorney, Agent, or Firm*—Milton L. Honig; James J. Farrell

[57] ABSTRACT

An aqueous concentrated fabric softening composition comprises an aqueous base, more than 10% of a water-soluble cationic softener and at least 3% of an alkoxylated amine having less than 7 alkylene oxide groups per molecule such as ethoxylated tallow amine. The total level of cationic and nonionic components is preferably less than 25%. The alkoxylated amine improves processing by lowering the initial viscosity of the product.

6 Claims, No Drawings

AQUEOUS CONCENTRATED FABRIC SOFTENING COMPOSITION

This invention relates to an aqueous concentrated fabric softening composition, in particular to such a composition which contains more than 10% by weight of a water-insoluble cationic fabric softener.

Concentrated fabric softening compositions containing more than 10% by weight of a water-insoluble cationic fabric softener suffer from the disadvantage of high viscosities which inter alia makes such products difficult to process. It has been proposed in European Patent Specification No EP-A-56695 (PROCTER & GAMBLE) that viscosity can be controlled by the use of small quantities, specifically up to 3% by weight of alkoxylated amines.

We have now surprisingly discovered that the processing of concentrated fabric softening compositions can be improved by the inclusion of higher levels of specific alkoxylated amines in the product. The benefit of this improved processing can be seen in a lower initial product viscosity.

Thus, according to the invention, there is provided an aqueous concentrated fabric softening composition comprising:

(i) an aqueous base;

(ii) more than 10% by weight of a water-insoluble cationic fabric softener; and (iii) more than 3% by weight of a nonionic material which is an alkylene oxide adduct of a fatty amine, the fatty amine containing at least 10 carbon atoms and the adduct containing an average of not more than 7 alkylene oxide groups per molecule, the total level of the cationic softener and the nonionic material being not more than 36% by weight, preferably not more than about 25% by weight.

The level of cationic softener in the composition is preferably from 10.5% to 21% by weight. The level of the nonionic material in the composition is preferably more than 4% to 12.0% by weight. The weight ratio of the cationic softener to the nonionic material is preferably at least 1:1, such as between about 1.5:1 and about 4:1.

The water-insoluble cationic fabric softener can be any fabric-substantive cationic compound which has a solubility in water at pH 2.5 and 20° C. of less than 10 g/l. Highly preferred materials are quaternary ammonium salts having two $C_{12}$–$C_{24}$ alkyl or alkenyl chains, optionally substituted or interrupted by functional groups such as —OH, —O—, —CONH, —COO—, etc.

Well known species of substantially water-insoluble quaternary ammonium compounds have the formula

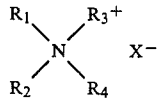

wherein $R_1$ and $R_2$ represent hydrocarbyl groups from about 12 to about 24 carbon atoms; $R_3$ and $R_4$ represent hydrocarbyl groups containing from 1 to about 4 carbon atoms; and X is an anion, preferably selected from halide, methyl sulfate and ethyl sulfate radicals. Representative examples of these quaternary softeners include ditallow dimethyl ammonium chloride; ditallow dimethyl ammonium methyl sulfate; dihexadecyl dimethyl ammonium chloride; di(hydrogenated tallow alkyl) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; di(coconut alkyl) dimethyl ammonium chloride. Ditallow dimethyl ammonium chloride, di(hydrogenated tallow alkyl) dimethyl ammonium chloride, di(coconut alkyl) dimethyl ammonium chloride and di(coconut alkyl) dimethyl ammonium methosulfate are preferred.

Another class of preferred water-insoluble cationic materials are the alkylimidazolinium salts believed to have the formula:

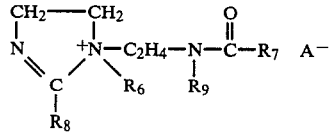

wherein $R_6$ is an alkyl or hydroxyalkyl group containing from 1 to 4, preferably 1 or 2 carbon atoms, $R_7$ is an alkyl or alkenyl group containing from 8 to 25 carbon atoms, $R_8$ is an alkyl or alkenyl group containing from 8 to 25 carbon atoms, and $R_9$ is hydrogen or an alkyl containing from 1 to 4 carbon atoms and $A^-$ is an anion, preferably a halide, methosulfate or ethosulfate. Preferred imidazolinium salts include 1-methyl-1-(tallowylamido-)ethyl-2-tallowyl-4,5-dihydroimidazolinium methosulfate and 1-methyl-1(palmitoylamido)ethyl-2-octadecyl-4,5-dihydroimidazolinium chloride. Other useful imidazolinium materials are 2-heptadecyl-1-methyl-1-(2-stearylamido)ethyl-imidazolinium chloride and 2-lauryl-1-hydroxyethyl-1-oleyl-imidazolinium chloride. Also suitable herein are the imidazolinium fabric softening components of U.S. Pat. No. 4,127,489, incorporated by reference. Representative commercially available materials of the above classes are the quaternary ammonium compounds Arquad 2HT (ex AKZO); Noramium M2SH (ex CEKA); Aliquat-2HT (Trade Mark of General Mills Inc) and the imidazolinium compounds Varisoft 475 (Trade Mark of Sherex Company, Columbus Ohio) and Rewoquat W7500 (Trade Mark of REWO).

The nonionic material is an alkylene oxide adduct of a fatty amine.

Alkylene oxide adducts of fatty amines useful in the present invention, preferably have the general formula

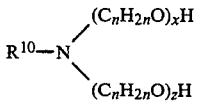

wherein $R^{10}$ is an alkyl or alkenyl group having at least 10 carbon atoms, most preferably from 10 to 22 carbon atoms, n is 2 or 3 and x and z in total are most preferably not more than 4.0, preferably from about 0.5 to about 3.5. Examples of such materials include Ethomeen T12 (tallow amine 2EO, available from AKZO), Optamine PC5 (coconut alkyl amine 5EO) and Crodamet 1.02 (oleylamine 2EO, available from Croda Chemicals).

The viscosity of the product, when measured at 110 $sec^{-1}$ shear rate should be less than about 150 cP, preferably between about 20 and about 100 cP and the product can be added as such to a fabric rinse liquor or may be pre-diluted with water.

Preferably, the compositions of the invention contain substantially no anionic material, in particular no anionic surface active materials. If such materials are present, the weight ratio of the cationic material to the anionic material should preferably be more than 10:1, such as more than 100:1.

The compositions may include electrolytes to assist in controlling the viscosity of the product. A suitable electrolyte level in the compositions is from about 0.01% to about 0.5%, most preferably from about 0.02% to about 0.2%, measured as the anhydrous salt. Examples of suitable materials include the ionic salts of sodium, potassium, lithium, magnesium, calcium or aluminium, such as lithium chloride, sodium chloride, ammonium chloride, sodium methosulphate, sodium benzoate, calcium chloride, magnesium chloride or aluminium chloride. Of these, sodium and potassium salts are less preferred.

The compositions may include low levels of solvents for the cationic fabric softener. Indeed, the cationic raw materials will often include isopropanol as a solvent. It is preferred that the level of isopropanol or any other $C_1$–$C_4$ monohydric alcohol in the composition is less than about 10% by weight, most preferably less than about 5% by weight.

Additionally the composition can contain substances for maintaining the stability of the product on cold storage. Examples of such substances include polyhydric alcohols such as ethylene glycol, propylene glycol, glycerol and polyethylene glycol. A suitable level for such materials is from about 0.5% to about 5%, preferably about 1.0% to 2.0% by weight.

The compositions of the invention may further include other additional ingredients including colourants, perfumes, preservations, anti-foams, optical brighteners, opacifiers, pH buffers (the preferred pH for the compositions is between about 3 and about 8, such as from about 4 to about 6), further viscosity modifiers, non-cationic fabric conditioning agents, anti-shrinkage agents, anti-wrinkle agents, fabric crisping agents, spotting agents, soil-release agents, germicides, anti-oxidants and anti-corrosion agents.

The compositions of the invention may be prepared by a variety of methods. One suitable method is to form a molten mixture of the cationic fabric softener and the nonionic material, add this molten mixture to water with stirring to form a dispersion and thereafter adding any optional ingredients. Alternatively, the molten amine may be added to water containing a strong acid (such as hydrochloric or phosphoric acid), in order to increase the solubility thereof by the formation of a corresponding amine salt. The molten cationic may then be added with stirring to form a dispersion and thereafter optional ingredients are added.

The invention will now be illustrated by the following Examples, where all parts and percentages are by weight. Where commercially available materials are referred to, the percentages quoted are of the active ingredients therein. Viscosities were measured in a Haake Rotoviscometer (Model RV 2) at 110 $sec^{-1}$ and 25° C.

EXAMPLES 1 TO 5

Compositions were prepared according to the formulations in the following Table. The compositions were prepared by adding molten amine to water containing hydrochloric acid on a 1:1 molar basis with respect to the amine, dispersing molten cationic therein at 65° C. by stirring, adding electrolyte in the form of a saturated solution, cooling and then adding perfume. The compositions were made in batches of 100 g. Stirring was continued for 7 minutes at 500 rpm.

| | EXAMPLE NO: | | | | | |
|---|---|---|---|---|---|---|
| Ingredient (%) | 1 | 2 | 3 | 4 | 4A | 5 |
| Arquad 2HT[1] | 12.0 | 11.5 | 10.5 | 14.0 | 17.5 | 11.0 |
| Ethomeen T12[2] | 3.5 | 3.5 | 4.5 | — | — | 3.5 |
| Optamine PC5[3] | — | — | — | 3.5 | | — |
| Hardened tallow fatty acid | — | — | — | — | — | 0.5 |
| Calcium chloride | 0.05 | 0.05 | 0.05 | 0.05 | 0.05 | 0.05 |
| Water and minor ingredients | | | balance | | | |
| Initial viscosity (cP) | | | | 91 | 200 | |

[1]A commercially available di-hardened tallow dimethyl ammonium chloride (about 82% active - balance water and isopropanol)

[2]Ethoxylated tallow amine having approximately 2 ethylene oxide groups per molecule.

[3]Ethoxylated coco-amine having approximately 5 ethylene oxide groups per molecule.

EXAMPLE 6

To demonstrate the benefit of including more than 3% alkoxylated amine in the compositions of this invention, the following compositions were prepared using the method described in Example 1 and their initial viscosities were measured.

| | Example No: | |
|---|---|---|
| Ingredients (%) | 6 | 6A |
| Arquad 2HT | 14.0 | 15.0 |
| Optamine PC5 | 3.5 | 2.5 |
| Calcium chloride | 0.05 | 0.05 |
| Water | balance | |
| Viscosity (cP) | 91 | >500 |

These results demostrate that a product with an acceptably low initial viscosity can be produced when the level of the alkoxlated amine is above 3%.

We claim:

1. An aqueous concentrated fabric softening composition comprising:

(i) an aqueous base;

(ii) more than 10% by weight of a water-insoluble cationic fabric softener; and (iii) about 3.5% by weight of a nonionic material which is a fatty coco amine ethoxylated with an average of approximately 5 ethylene oxide groups per molecule, the total level of the cationic softener and the nonionic material being not more than 36% by weight.

2. An aqueous concentrated fabric softening composition according to claim 1, comprising from 10.5% to 21% by weight of said water-insoluble cationic fabric softener.

3. An aqueous concentrated fabric softening composition according to claim 1, wherein the weight ratio of said water-insoluble cationic fabric softener and said nonionic material is at least 1:1.

4. An aqueous concentrated fabric softening composition according to claim 1, further comprising an electrolyte selected from ionic salts of lithium, magnesium, calcium, aluminium and mixtures thereof.

5. A process for preparing an aqueous concentrated fabric softening composition according to claim 1, wherein a molten mixture of the cationic softener and the nonionic material is added to water with stirring to form a dispersion.

6. A process for preparing an aqueous concentrated fabric softening composition according to claim 1, wherein the molten nonionic material is added to water containing a strong acid and thereafter molten cationic softener is added with stirring to form a dispersion.

* * * * *